US011965230B2

(12) United States Patent
Sun

(10) Patent No.: US 11,965,230 B2
(45) Date of Patent: Apr. 23, 2024

(54) MULTIPHASE ULTRA-HIGH STRENGTH HOT ROLLED STEEL

(71) Applicant: Nucor Corporation, Charlotte, NC (US)

(72) Inventor: Weiping Sun, Huger, SC (US)

(73) Assignee: NUCOR CORPORATION, Charlotte, NC (US)

( * ) Notice: Subject to any disclaimer, the term of this patent is extended or adjusted under 35 U.S.C. 154(b) by 53 days.

(21) Appl. No.: 17/201,723

(22) Filed: Mar. 15, 2021

(65) Prior Publication Data

US 2021/0198774 A1 Jul. 1, 2021

Related U.S. Application Data

(63) Continuation of application No. 15/803,401, filed on Nov. 3, 2017, now Pat. No. 11,021,776.
(Continued)

(51) Int. Cl.

| | |
|---|---|
| ***C22C 38/16*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |

(Continued)

(52) U.S. Cl.
CPC ..... *C22C 38/16* (2013.01); *C21D 8/0226* (2013.01); *C22C 38/001* (2013.01); *C22C 38/02* (2013.01); *C22C 38/04* (2013.01); *C22C 38/06* (2013.01); *C22C 38/12* (2013.01); *C23C 2/02* (2013.01); *C23C 2/024* (2022.08); *C23C 2/06* (2013.01); *C23C 2/28* (2013.01); *C23C 2/40* (2013.01); *C21D 2211/001* (2013.01);
(Continued)

(58) Field of Classification Search
CPC ..... C21D 2211/002; C21D 2211/005; C21D 2211/008; C21D 8/0236; C22C 38/04; C22C 38/12; C22C 38/16; C23C 2/40
USPC ..... 148/337
See application file for complete search history.

(56) References Cited

U.S. PATENT DOCUMENTS 3,988,173 A 10/1976 Kawano
3,988,174 A 10/1976 Kawano
(Continued)

FOREIGN PATENT DOCUMENTS

WO 2015039763 A2 3/2015

OTHER PUBLICATIONS

Ghaheri, A., et al., "Effects of inter-critical temperatures on martensite morphology, volume fraction and mechanical properties of dual-phase steels obtained from direct and continuous annealing cycles" , Materials and Design, 2014, pp. 305-319, vol. 62.

*Primary Examiner* — Jie Yang
(74) *Attorney, Agent, or Firm* — Christopher J. Knors; Moore & Van Allen PLLC

(57) ABSTRACT

A hot rolled, ultra-high strength, complex metallographic structured or multi-phase structured steel that improves formability during stamping or forming process, while possessing one or more of the following properties: excellent castability, rollability and coatability, excellent structural performance, excellent stretch formability, excellent stretch flangeability, excellent dent resistance, excellent durability, excellent impact performance, excellent intrusion and crash resistance without the purposeful addition of boron.

14 Claims, 5 Drawing Sheets

Related U.S. Application Data

(60) Provisional application No. 62/417,571, filed on Nov. 4, 2016.

(51) Int. Cl.

| | |
|---|---|
| ***C22C 38/06*** | (2006.01) |
| ***C22C 38/12*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(52) U.S. Cl.
CPC .. *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 6,410,163 | B1 | 6/2002 | Suzuki et al. |
| 7,442,268 | B2 | 10/2008 | Sun |
| 7,540,993 | B2 | 6/2009 | Reinhold et al. |
| 7,578,894 | B2 | 8/2009 | Reinhold et al. |
| 7,879,160 | B2 | 2/2011 | Sun |
| 7,959,747 | B2 | 6/2011 | Sun |
| 8,337,643 | B2 | 12/2012 | Sun |
| 8,366,844 | B2 | 2/2013 | Sun |
| 8,460,481 | B2 | 6/2013 | Azuma et al. |
| 8,657,970 | B2 | 2/2014 | Yoshinaga et al. |
| 8,733,144 | B2 | 5/2014 | Pohl et al. |
| 8,888,933 | B2 | 11/2014 | Hayashi et al. |
| 8,999,085 | B2 | 4/2015 | Kim et al. |
| 9,109,275 | B2 | 8/2015 | Morimoto et al. |
| 9,157,138 | B2 | 10/2015 | Sun |
| 9,162,422 | B2 | 10/2015 | Kawata et al. |
| 9,194,015 | B2 | 11/2015 | Ikeda et al. |
| 9,593,399 | B2 | 3/2017 | Jamwal et al. |
| 2004/0035500 | A1 | 2/2004 | Ikeda et al. |
| 2004/0060623 | A1 | 4/2004 | Boke et al. |
| 2006/0108035 | A1 | 5/2006 | Sun |
| 2008/0289726 | A1 | 11/2008 | Sun |
| 2009/0071574 | A1 | 3/2009 | Sun |
| 2009/0071575 | A1 | 3/2009 | Sun |
| 2009/0242085 | A1 | 10/2009 | Ikeda et al. |
| 2012/0018059 | A1 | 1/2012 | Sun |
| 2012/0222781 | A1 | 9/2012 | Azuma et al. |
| 2012/0304448 | A1 | 12/2012 | Hartmann et al. |
| 2012/0305144 | A1 | 12/2012 | Okamoto et al. |
| 2013/0273392 | A1 | 10/2013 | Nonaka et al. |
| 2014/0166163 | A1 | 6/2014 | Jamwal et al. |
| 2014/0234657 | A1 | 8/2014 | Azuma et al. |
| 2014/0234660 | A1* | 8/2014 | Kawata ..... B21B 1/22 148/504 |
| 2014/0242415 | A1 | 8/2014 | Azuma et al. |
| 2014/0311631 | A1 | 10/2014 | Hayashi et al. |
| 2014/0342183 | A1 | 11/2014 | Wakabayashi et al. |
| 2015/0079420 | A1 | 3/2015 | Hanlon et al. |
| 2015/0266519 | A1 | 9/2015 | Kim et al. |
| 2016/0289809 | A1 | 10/2016 | Hanlon et al. |
| 2018/0127855 | A1 | 5/2018 | Sun |
| 2021/0156010 | A1* | 5/2021 | Sun ..... C23C 2/12 |

* cited by examiner

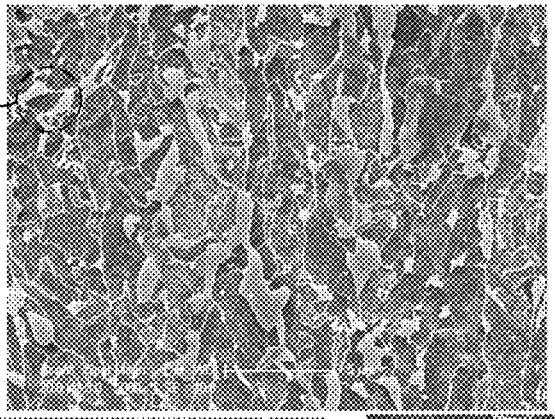
FIG. 3A
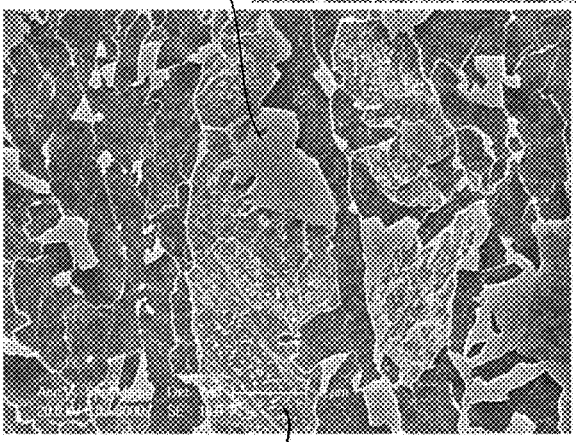
FIG. 3B
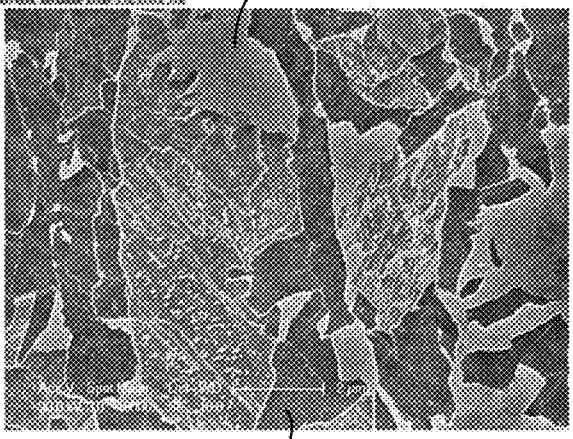
FIG. 3C
FIG. 4A
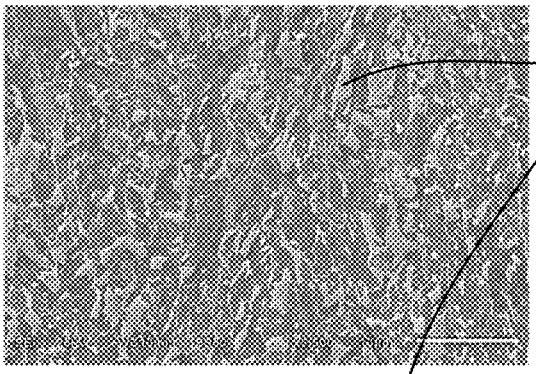
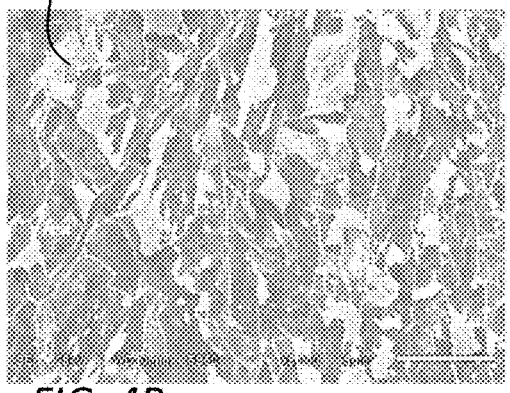
FIG. 4B
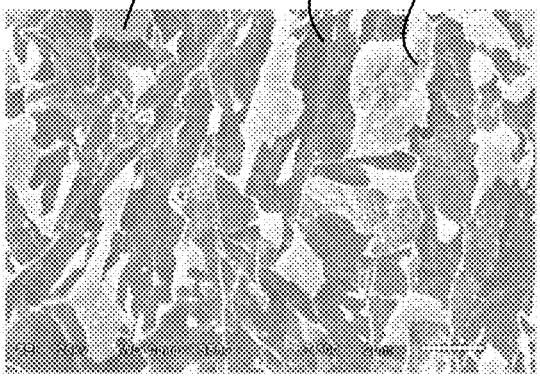
FIG. 4C

MULTIPHASE ULTRA-HIGH STRENGTH HOT ROLLED STEEL

CROSS-REFERENCE TO RELATED APPLICATION

This application is a Continuation of U.S. application Ser. No. 15/803,401, filed Nov. 3, 2017, which claims the benefit of U.S. Provisional Application No. 62/417,571, filed Nov. 4, 2016, the entirety of each of which is incorporated herein by reference, and the benefit of the filing date of the provisional application is hereby claimed for all purposes that are legally served by such claim for the benefit of the filing date.

TECHNICAL FIELD

The present disclosure relates to a complex metallographic structured or multi-phase hot-rolled steel.

BACKGROUND

With ever-increasing pressure on the automotive and other industries for energy savings and emission reduction while improving product performance and cost competitiveness, more parts such as automotive parts are being manufactured using high strength steel. Some high strength steels enable use of thinner sheet to reduce the product weight, which improves vehicle fuel efficiency. Further, it is desired to improve vehicle durability, crashworthiness, intrusion resistance and impact performance to protect a driver and passengers upon collision.

Certain industries, including the automotive industry, are utilizing advanced high strength steel, or "AHSS," including dual phase steels and transformation induced plasticity, or TRIP steels. AHSS steels may meet certain strength and weight targets while using existing manufacturing infrastructure. These steels appear promising for applications requiring high press-forming and draw-forming properties to form parts with complex shapes.

However, problems related to the stamping, forming and drawing of prior AHSS steels are well known, and significant hurdles exist for successful implementation using the existing manufacturing infrastructure. Prior AHSS steels exhibited wear of tooling during cold-drawing and/or shear fracture, edge fracture, and edge cracking during the stamping or forming of a variety of parts, difficulty with welding and casting, and very high production costs associated with hot-stamping or high temperature press forming or hardening, as a result. Because of this, theses AHSS steels have limiting design flexibility and increasing manufacturing uncertainty.

Moreover, high concentrations of some alloy elements, such as carbon (C), silicon (Si) and aluminum (Al) present in steels deteriorate the surface quality and weldability of the steel. In particular, difficulty in welding boron-containing steels has become a significant challenge for the steel in the automotive industry, and therefore further limits automotive applications of this type of steel.

SUMMARY

In a first embodiment, a hot rolled, complex metallographic structured steel sheet is provided, the steel sheet comprising: (a) a composition comprising the following elements by weight: carbon in a range from about 0.02% to about 0.2%, manganese in a range from about 1.0% to about 3.5%, phosphorous less than or equal to about 0.1%, silicon less than or equal to about 1.2%, aluminum in a range from about 0.01% to about 0.10%, nitrogen less than or equal to about 0.02%, copper less than or equal to about 0.5%, vanadium less than or equal to about 0.12%, the composition having no purposeful addition of boron, and the balance of the composition comprising iron and incidental ingredients.

In a first aspect of the first embodiment, the hot rolled, complex metallographic structured steel sheet comprises a multi-phase microstructure having in combination: bainite between 15% and 45% by volume, martensite+austenite (M+A) constituent between 5% and 35% by volume, tempered and non-tempered martensite at less than 15% by volume, the remainder volume essentially ferrite.

In a second aspect, alone or in combination with any of the previous aspects, the complex metallographic structured further comprises at least one chemical element chosen from molybdenum, chromium, nickel, and a combination thereof, in a range between about 0.05% and about 3.5%, wherein, if present, molybdenum (Mo) is present with chromium (Cr) satisfying a relationship Mo+Cr greater than or equal to about 0.05% and less than or equal to about 2.0%, and, wherein, if present, nickel (Ni) is present with copper (Cu) satisfying a relationship Ni+Cu of less than or equal to about 0.8% by weight.

In a third aspect, alone or in combination with any of the previous aspects of the first embodiment, the complex metallographic structured steel sheet further comprises at least one chemical element chosen from titanium, niobium and a combination thereof, in a range between about 0.005% and about 0.8%.

In a fourth aspect, alone or in combination with any of the previous aspects of the first embodiment, hot rolled, complex metallographic structured steel sheet has a tensile strength greater than about 1000 megapascals.

In a fifth aspect, alone or in combination with any of the previous aspects of the first embodiment, the hot rolled, complex metallographic structured steel sheet has at least one of the following properties of elongation greater than about 10% in accordance with ASTM E8, and yield/tensile ratio greater than about 65%.

In a sixth aspect, alone or in combination with any of the previous aspects of the first embodiment, the hot rolled, complex metallographic structured steel sheet has tensile strength greater than about 1000 megapascals, elongation greater than about 10% in accordance with ASTM E8, and yield/tensile ratio greater than about 65%.

In a seventh aspect, alone or in combination with any of the previous aspects of the first embodiment, the martensite+austenite (M+A) constituent of the microstructure is between 10% and 20% by volume and the bainite phase of the microstructure is between 25% and about 35% by volume of the microstructure.

In a second embodiment, a method of making a complex metallographic structured hot rolled steel sheet is provided, the method comprising: a) introducing molten steel into metal slab caster having a casting mold and continuously casting a molten steel into a slab, the molten steel having a composition comprising the following elements by weight: carbon in a range from about 0.02% to about 0.2%, manganese in a range from about 1.0% to about 3.5%, phosphorous less than or equal to about 0.1%, silicon less than or equal to about 1.2%, aluminum in a range from about 0.01% to about 0.10%, nitrogen less than or equal to about 0.02%, copper less than or equal to about 0.5%, vanadium less than or equal to about 0.12%, the composition having no purposeful addition of boron, and the balance of the composition comprising iron and incidental ingredients; b) hot rolling the steel slab; c) cooling the hot rolled steel; and obtaining a multi-phase microstructure.

In a first aspect of the second embodiment, the multiphase microstructure comprises, in combination, bainite between 15% and 45% by volume, martensite+austenite (M+A) constituent between 5% and 35% by volume, tempered and non-tempered martensite at less than 15% by volume, the remainder volume essentially ferrite.

In a second aspect, alone or in combination with any of the previous aspects of the second embodiment, the chemical composition comprises at least one chemical element chosen from molybdenum, chromium, nickel, or a combination thereof, in a range between about 0.05% by weight and about 3.5% by weight, wherein, if present, molybdenum (Mo) is present with chromium (Cr) satisfying a relationship Mo+Cr greater than or equal to about 0.05% and less than or equal to about 2.0%, and, wherein, if present, nickel (Ni) is present with copper (Cu) satisfying a relationship Ni+Cu being less than or equal to about 0.8%, In a third aspect, alone or in combination with any of the previous aspects of the second embodiment, the chemical composition comprises at least one chemical element chosen from titanium, niobium and a combination thereof, in a range between about 0.005% and about 0.8%.

In a fourth aspect, alone or in combination with any of the previous aspects of the second embodiment, the method further comprises coiling the steel at a temperature between about 425° C. (about 797° F.) and about 825° C. (about 1517° F.)

In a fifth aspect, alone or in combination with any of the previous aspects of the second embodiment, the steel slab has an exit temperature in a range between about (Ar3-30)° C. and about 1025° C. (about 1877° F.) prior to hot rolling.

In a sixth aspect, alone or in combination with any of the previous aspects of the second embodiment, the steel slab is cooled at a mean cooling rate of at least about 3° C./s (about 37.4° F./s).

In a third embodiment, an article made by the method of any one of method claims is provided.

BRIEF DESCRIPTION OF THE DRAWINGS

FIGS. 3A, 3B, and 3C, is a scanning transmission electron microscope image of an embodiment of the present disclosure.

FIGS. 4A, 4B, and 4C is a scanning transmission electron microscope image of an embodiment of the present disclosure.

DETAILED DESCRIPTION

Figure 1:
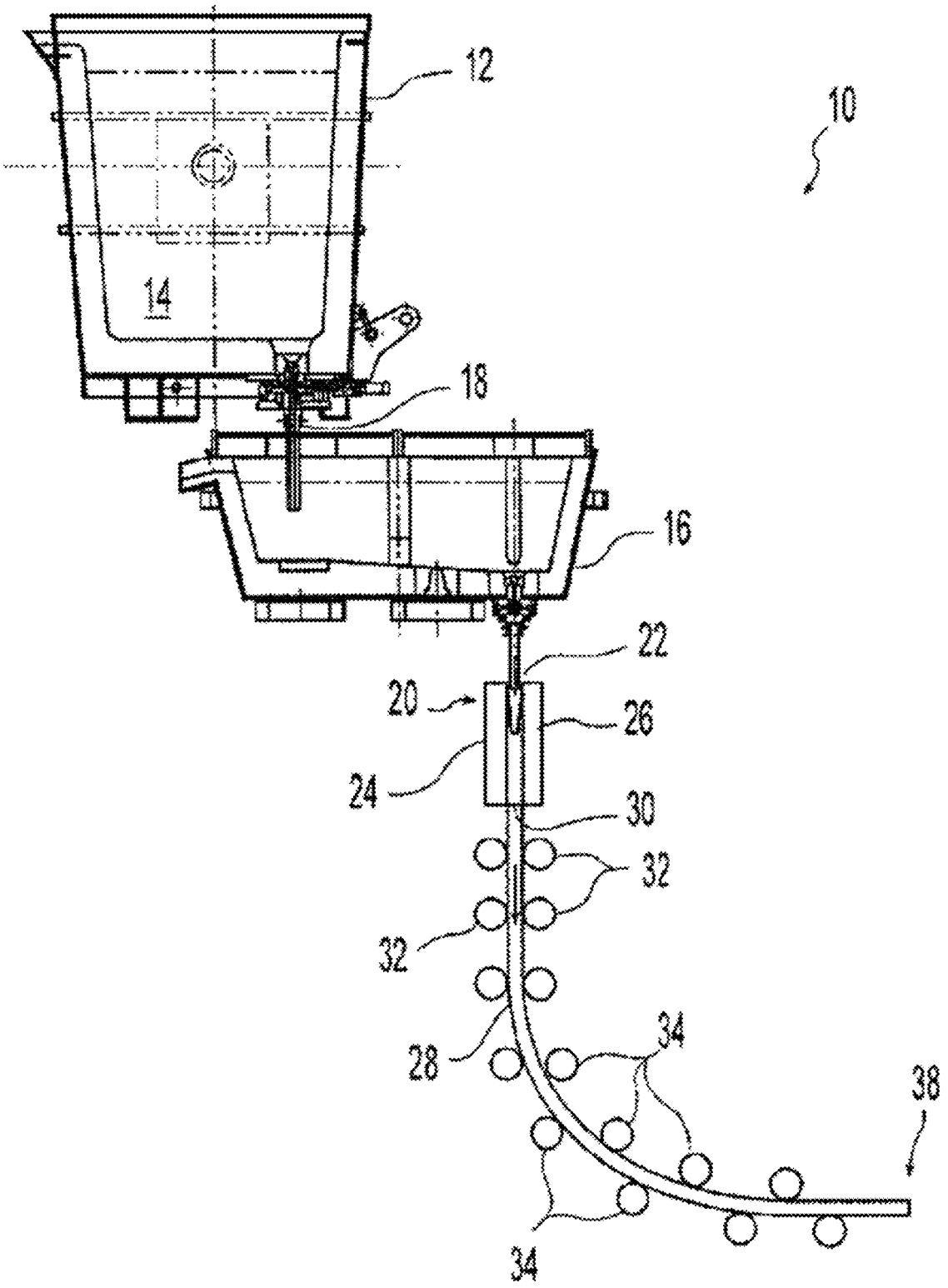
FIG. 1 is a diagrammatic side view of a caster that may be used for producing the hot rolled steel sheet according to the present disclosure.

In general, the increase in strength of a material causes material characteristics such as formability (workability) or weldability to deteriorate, such as in boron-containing steels. Therefore, it is desirable to achieve the increase in strength without the deterioration in the material characteristics for developing a high-strength steel sheet. A hot rolled, high strength, complex metallographic structured or multi-phase structured steel is presently disclosed that improves forming performance during stamping, while possessing one or more of the following properties: excellent castability, weldability, formability, crashworthiness, intrusion resistance and excellent durability.

A hot rolled, complex metallographic structured steel sheet is disclosed and provided comprising: (a) a composition comprising the following elements by weight: carbon in a range from about 0.02% to about 0.2%; manganese in a range from about 1.0% to about 3.5%; phosphorous less than or equal to about 0.1%; silicon less than or equal to about 1.2%; aluminum in a range from about 0.01% to about 0.10%; nitrogen less than or equal to about 0.02%; copper less than or equal to about 0.5%; vanadium less than or equal to about 0.12%; at least one metal chosen from molybdenum, chromium, nickel, and a combination thereof, in a range between about 0.05% and about 3.5%, wherein, if present, molybdenum (Mo) is present with chromium (Cr) satisfying a relationship Mo+Cr greater than or equal to about 0.05% and less than or equal to about 2.0%, and, wherein, if present, nickel (Ni) is present with copper (Cu) satisfying a relationship Ni+Cu being less than or equal to about 0.8%; one metal may be chosen from titanium, niobium and a combination thereof, in a range between about 0.005% and about 0.5%; the composition having no purposeful addition of boron; and the balance of the composition comprising iron and incidental ingredients.

In one embodiment, the multiphase steel sheet of the above composition has a multi-phase microstructure, having in combination bainite between 15% and 45% by volume, martensite+austenite (M+A) constituent between 5% and 35% by volume, tempered and non-tempered martensite at less than 15% by volume, the remainder volume essentially ferrite. Alternately, the martensite+austenite (M+A) constituent of the microstructure is between 10% and 30% by volume. In one aspect, the bainite phase of the microstructure is between 25% and about 40% by volume of the microstructure.

In one embodiment, the multiphase steel sheet of the above composition has physical properties comprising tensile strength greater than about 1000 megapascals and at least one of the following properties of elongation greater than about 10% in accordance with ASTM E8, yield/tensile ratio greater than about 65%.

In one embodiment, the multiphase steel sheet of the above composition has a multi-phase microstructure, having in combination bainite between 15% and 45% by volume, martensite+austenite (M+A) constituent between 5% and 35% by volume, tempered and non-tempered martensite at less than 15% by volume, the remainder volume essentially ferrite and has physical properties comprising tensile strength greater than about 1000 megapascals and at least one of the following properties of elongation greater than about 10% in accordance with ASTM E8, and a yield/tensile ratio greater than about 65%.

The presently disclosed complex metallographic structured steel has a uniform microstructure essentially throughout the thickness of the sheet with some minor microstructure/morphology variations at the opposing surfaces due to contact with processing equipment and/or cooling effects.

The multi-phase steel composition includes carbon in an amount of at least about by weight. Additional carbon may be used to increase the formation of martensite, such as at least 0.02% by weight. However, a large amount of carbon in the steel may degrade the formability and weldability, so the upper limit of carbon in the present multiphase steel is about 0.2%. In one embodiment, the multiphase steel composition comprises a carbon content of about 0.05 to about 0.1% by weight.

Manganese is present at least about 0.2% by weight in order to ensure the strength and hardenability of the multiphase steel. Additional manganese may be added to enhance the stability of forming the martensite phase in the steel, such as at least about 0.5% by weight. However, when the amount exceeds about 3.5% by weight the weldability of the steel may be adversely affected, so the manganese content is less than about 3.5% by weight. In one embodiment, the manganese content is between about 1.0 and 3.5% by weight. In one embodiment, the manganese content is between about 1.5 and 3.0% by weight. In one embodiment, the manganese content is between about 2.0 and 2.5% by weight.

Although no phosphorus may be present, a small amount of phosphorus can be added because in principle, phosphorus exerts a similar affect to manganese and silicon in view of solid solution hardening. However, when a large amount of phosphorus is added to the steel, the castability and rollability of the steel are deteriorated. Excess phosphorus segregates at grain boundaries and causes brittleness of the steel. Moreover, the excessive addition of phosphorus degrades the surface quality of the hot rolled steel. For these reasons, the amount of phosphorus is less than about 0.1% by weight. Alternately, the amount of phosphorus is less than about 0.08% by weight, and may be less than about 0.06% by weight. In one embodiment, the phosphorus content is between 0.001 and 0.1% by weight. In one embodiment, the phosphorus content is between 0.01 and 0.05% by weight. In one embodiment, the phosphorus content is between and 0.02% by weight.

Calcium helps to modify the shape of sulfides. As a result, calcium reduces the harmful effect due to the presence of sulfur and eventually improves the toughness, stretch flangeability, and fatigue properties of the steel. However, in the present complex metallographic structured steel sheet, this beneficial effect does not increase when the amount of calcium exceeds about by weight. The upper limit of calcium is about 0.02% by weight. Alternately, the amount of calcium is less than about 0.01% by weight.

Silicon is added as a strengthening element, for improving the strength of the steel with little decrease in the ductility or formability. In addition, silicon promotes the ferrite transformation and delays the pearlite transformation, which is useful for stably attaining a complex metallographic structure or multi-phase structure in the steel. However, excessive addition of silicon can degrade the surface quality of the steel. The silicon content in the multi-phase steel is less than about 1.2% by weight. Alternately, the silicon content is less than about 1% by weight. In one embodiment, the silicon content is between 0.1 and 1.0% by weight. In one embodiment, the silicon content is between 0.2 and 0.8% by weight. In one embodiment, the silicon content is between 0.3 and 0.7% by weight.

Aluminum is employed for deoxidization of the steel and is effective in fixing nitrogen to form aluminum nitrides. The lower limit of aluminum as a deoxidization element is about by weight. However, to preserve the ductility and formability of the steel, aluminum is less than about 0.1% by weight. Alternately, the amount of aluminum is less than about 0.09% by weight, and may be less than about 0.08% by weight. In one embodiment, the aluminum content is between 0.01 and 0.1% by weight. In one embodiment, the aluminum content is between and 0.06% by weight.

When boron is purposely added, the castability, rollability, and other processing capabilities of the steel typically are lowered or rendered less desirable. Although no boron should be present (intentionally or purposely added) in the steel sheet of the present disclosure, the presence of a small amount of unintentionally added boron is tolerable, as it would be difficult to remove, and provided that it does not adversely affect the casting or rollability of the steel. The upper limit of unintentionally added boron content is about 0.0015% by weight (15 ppm), 0.001% by weight (10 ppm), 0.0005% by weight (5 ppm), or less.

The addition of a small amount of nitrogen may be beneficial. However, the upper limit of nitrogen content is about 0.02%. Alternately, the amount of nitrogen is less than about and may be less than about 0.012% by weight.

Molybdenum, chromium, copper, and nickel are effective for increasing the hardenability and strength of the steel. These elements are also useful for stabilizing the retaining austenite and promoting the formation of martensite while having little effect on austenite to ferrite transformation. These elements can also improve the impact toughness of steel because these elements contribute to the suppression of formation and growth of micro-cracks and voids. In the presently disclosed steel, the sum of the weight percent of Mo+Cr is about 0.05 to 2.0. Alternately, the sum of Mo+Cr is about 0.5 to 1.5. In the presently disclosed steel sheet, the sum of the weight percent of Ni+Cu is about 0.005 to 0.5. Alternately, the sum of Ni+Cu is about 0.1 to 0.3. In one aspect, nickel and copper are not purposefully added, however, may nonetheless be present in scrap steel at varying amounts, and if present, nickel (Ni) is present with copper (Cu) satisfying a relationship Ni+Cu of less than or equal to about 0.8% by weight.

The addition of niobium and titanium is beneficial as these alloying elements in solid solution can refine grains of the steel and increase the strength of the steel through "solution strengthening" mechanisms. Furthermore, these alloying elements may form very fine precipitates, which have a strong effect for retarding austenite recrystallization and also refining ferrite grains. These fine precipitates further increase the strength of the steel through "precipitation strengthening" mechanisms. These elements are also useful to accelerate the transformation of austenite to ferrite. One of niobium and titanium may be used alone, or they may be employed in combination. The sum of Ti+Nb is at least about 0.005% by weight. However, when the total content of these elements exceeds about 0.15% by weight, excess precipitates can be formed in the steel, increasing precipitation hardening and reducing castability and rollability during manufacturing the steel and forming parts. In the presently disclosed steel, the total content of niobium, titanium, or a combination thereof is limited to not more than about by weight. In one embodiment, niobium and titanium collectively present in an amount no more than about 0.08% by weight.

In one aspect, the presently disclosed steel comprises titanium (Ti) and niobium (Nb) in a range from about 0.005% to about 0.15%. Alternately, the total content of niobium and titanium is in a range from about 0.01% to about 0.08% by weight.

In one aspect, the addition of a small amount of vanadium can be used for retarding austenite recrystallization and refining ferrite grains, and for increasing the strength of the steel. However, when the total content of this element exceeds about 0.12% by weight, excess vanadium carbides and vanadium nitrides are precipitated out in the steel. Since these types of precipitates are usually formed on grain boundaries, excess vanadium carbides and vanadium nitrides can reduce castability during producing the steel sheet, and also deteriorate the formability of the steel sheet when forming or press forming the manufactured steel sheet into the final automotive parts. Moreover, the impact toughness, fracture resistance, crashworthiness, stretch formability, stretch flangeability and fatigue property of the steel sheet could also be reduced due to the occurrence of excess vanadium carbides and vanadium nitrides. Thus, the content of vanadium in the presently disclosed steel sheet is less than about 0.1% by weight. Alternately, the amount of vanadium present in the presently disclosed steel sheet is less than about 0.02% by weight.

In one aspect, the hot-rolled, high-strength complex metallographic structured steel is absent purposely added boron (B). In another aspect, the hot-rolled, high-strength complex metallographic structured steel is absent purposely added niobium (Nb), zirconium (Zr), boron (B), and tungsten (W).

In another aspect, the presently disclosed composition can contain a purposeful addition of calcium less than or equal to about 0.01% by weight.

Incidental ingredients and other impurities should be kept to as small a concentration as is practicable. Incidental ingredients are typically the ingredients arising from use of scrap metals and other additions in steel making, as occurs in preparation of molten composition in a steel making furnace.

By employing a steel starting material falling within the above composition, the manufacturing process to make steel sheet will have less demanding facility requirements and less restrictive processing controls. Further, the process may be carried out at existing mills without any additional equipment or added capital cost.

The complex metallographic structured hot rolled steel has a yield strength of at least about 650 megapascals (MPa), a yield strength of at least about 700 megapascals, a yield strength of at least about 750 megapascals, or a yield strength up to about 950 megapascals. In one embodiment, the complex metallographic structured hot rolled steel has a yield strength of between 750 and 850 megapascals.

The complex metallographic structured hot rolled steel has a tensile strength of at least about 950 megapascals (MPa), a tensile strength of at least about 1150 megapascals, or a tensile strength up to about 1100±100 megapascals. In one embodiment, the complex metallographic structured hot rolled steel has a tensile strength of between 1000 and 1100 megapascals.

The complex metallographic hot rolled structured steel as an elongation of about 10 to about 16%, or between 11 to 15% as measured in accordance with ASTM E8 testing protocol. The complex metallographic structured hot rolled steel has yield strength/tensile strength ratio of at least 70%. The complex metallographic structured hot rolled steel has yield strength/tensile strength ratio of between 70-85%.

Presently disclosed is a practical manufacturing method of reliably making the complex metallographic structured or multi-phase structured steel, which may be carried out by steel manufacturers with little or no increase in manufacturing cost.

A method of making the presently disclosed complex metallographic structured steel sheet comprises:

a) introducing molten steel into metal slab caster having a casting mold and continuously casting a molten steel into a slab, the molten steel having a composition comprising the following elements by weight: carbon in a range from about 0.02% to about 0.2%, manganese in a range from about 1.0% to about 3.5%, phosphorous less than or equal to about 0.1%, silicon less than or equal to about 1.2%, aluminum in a range from about 0.01% to about 0.10%, nitrogen less than or equal to about 0.02%, copper less than or equal to about 0.5%, vanadium less than or equal to about 0.12%, at least one metal chosen from molybdenum, chromium, nickel, and a combination thereof, in a range between about 0.05% and about 3.5%, wherein, if present, molybdenum (Mo) is present with chromium (Cr) satisfying a relationship Mo+Cr greater than or equal to about 0.05% and less than or equal to about 2.0%, and, wherein, if present, nickel (Ni) is present with copper (Cu) satisfying a relationship Ni+Cu being less than or equal to about 0.8%, at least one chosen from titanium, niobium and a combination thereof, in a range between about and about 0.5%, the composition having no purposeful addition of boron, and the balance of the composition comprising iron and incidental ingredients;

b) hot rolling the steel slab, the steel slab having an exit temperature in a range between about (Ar3-30)° C. and about 1025° C. (about 1877° F.);

c) cooling the hot rolled steel at a mean cooling rate of at least about 3° C./s (about 37.4° F./s);

d) optionally, coiling the steel at a temperature between about 425° C. (about 797° F.) and about 825° C. (about 1517° F.); and obtaining a multi-phase microstructure having in combination bainite between 15% and 45% by volume, martensite+austenite (M+A) constituent between 5% and 25% by volume, tempered and non-tempered martensite at less than 15% by volume, the remainder volume essentially ferrite.

FIG. 1 is a diagrammatical illustration of a continuous metal slab caster 10. The steel slab caster 10 includes a ladle 12 to provide molten steel 14 to a tundish 16 through a shroud 18. The tundish 16 directs the molten melt 14 to the casting mold 20 through a submerged entry nozzle (SEN) 22 connected to a bottom of the tundish 16. The casting mold 20 includes at least two opposing mold faces 24 and 26, which may be fixed or moveable. The SEN 22 delivers the molten melt into the casting mold 20 below the surface ("meniscus") of the molten metal in the casting mold 20. The width of cast strand 28 leaving the casting mold 20 is determined by the configuration of the caster mold faces at the mold exit at 30.

The two opposing mold faces 24 and 26 are broad mold faces, and the casting mold has two opposing narrow mold faces (not shown) to form a substantially rectangular configuration, or some other desired configuration for the cast strand 28. At least one pair of the mold faces of the casting mold 20 typically is oscillating to facilitate downward movement of the molten metal through the casting mold 20. The cast strand 28 enters sets of pinch rolls 32. The sets of pinch rolls 32 serve to feed the cast strand 28 downward and toward a withdrawal straightener 34.

The cast strand 28 enters the withdrawal straightener 34 which serves to transition direction of travel of the strand 28 to a substantially horizontal direction. The withdrawal straightener 34 provides support for the cast strand 28 as the strand cools and progresses at casting speed through the withdrawal straightener 34 toward at least one hot rolling mill 36. The withdrawal straightener 34 includes drives for its rolls (not shown) to move the cast strand 28 through the withdrawal straightener as casting proceeds.

Figure 2:
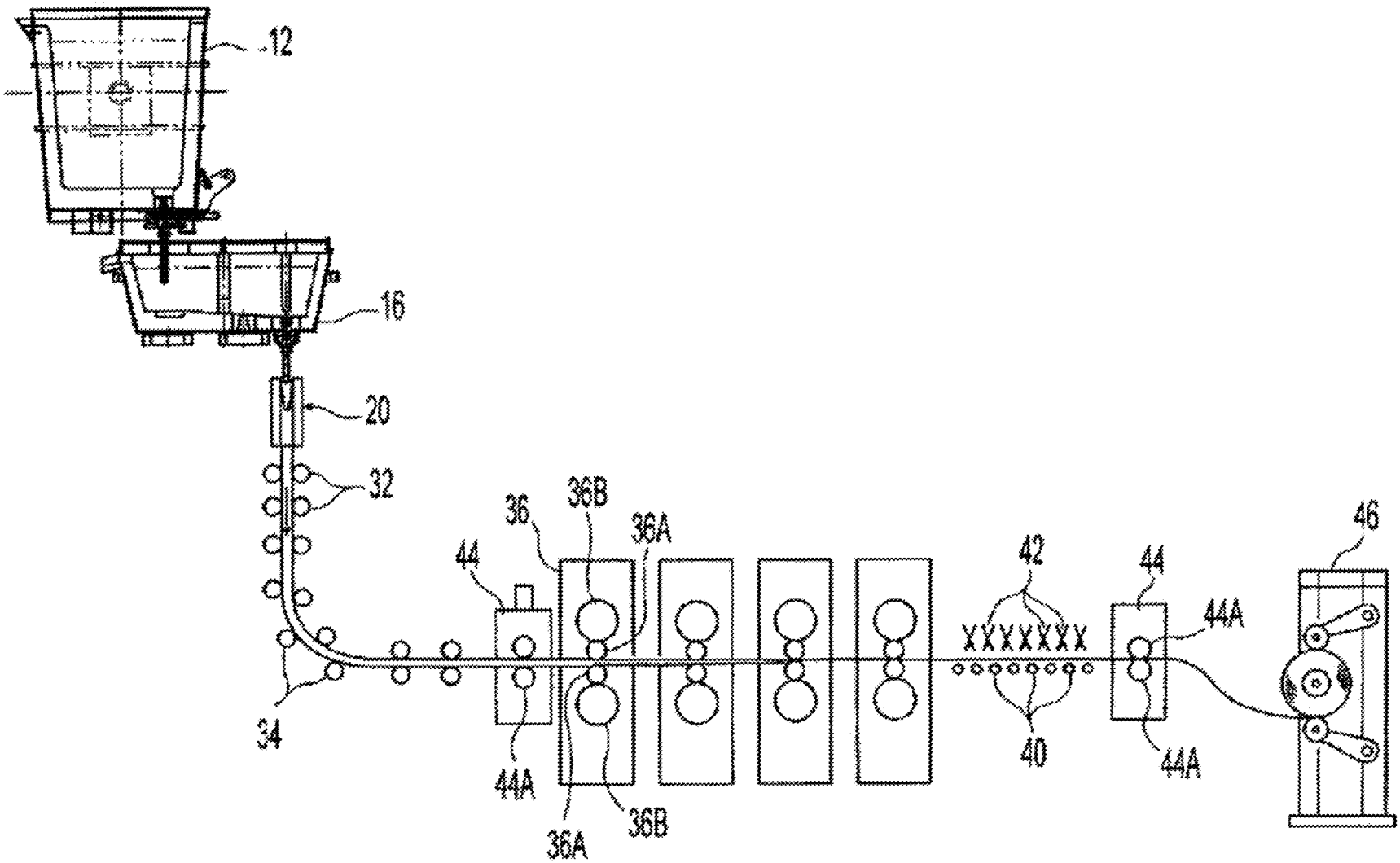
FIG. 2 is a diagrammatic side view of a casting process including hot rolling mills according to the present disclosure.

As shown in FIG. 2, the cast strand 28 passes through at least one hot rolling mill 36, comprising a pair of reduction rolls 36A and backing rolls 36B, where the cast strip is hot rolled to reduce to a desired thickness. The rolled strip passes onto a run-out table 40 where it is cooled by contact with water supplied via water jets 42 or by other suitable means, and by convection and radiation. In any event, the rolled strip may then pass through a pinch roll stand 44 comprising a pair of pinch rolls 44A and then optionally directed to a coiler 46.

Alternately, the strand 28 may be directed to a cutting tool 38, such as but not limited to a shear, after the cast metal strand exits the withdrawal straightener 34 and is sufficiently solidified to be cut laterally (i.e., transverse to the direction of travel of the cast strand). As the strand 28 is cut into slabs, blooms, or billets, for example, the intermediate product may be transported away on rollers or other supports to be hot rolled.

During casting, water (or some other coolant) is circulated through the casting mold 20 to cool and solidify the surfaces of the cast strand 28 at the mold faces. The rollers of the withdrawal straightener 34 may also be sprayed with water, if desired, to further cool the cast strand 28.

The hot rolled steel of the present disclosure has high yield strength, high tensile strength, and has a complex metallographic structure, or multi-phase structure. The multi-phase microstructure has, in combination martensite, ferrite, bainite, retained austenite, and optionally, fine precipitates. The multiphase structure has, in combination, bainite between 15% and 45% by volume, ma rtensite+ austenite (M+A) constituent between 5% and 35% by volume, tempered and non-tempered martensite at less than 15% by volume, the remainder volume essentially ferrite.

The multiphase steel sheet can be used directly or optionally, formed or worked or further reduced in thickness, and used in applications including, but not limited to, automobiles, ships, airplanes, trains, electrical appliances, building components and other machineries.

The multiphase steel of the present disclosure has one or more of a property chosen from excellent castability, rollability, coatability or galvanizability, formability, weldability, and excellent durability and crashworthiness, amongst other things, in a preferred embodiment, has excellent surface and shape quality.

By excellent castability and rollability, it is meant that the cast strand and rolling stands can readily cast and roll the steel without excessive wear to the mold, tundish, and/or rollers and/or straightener. Other processing equipment can benefit from the presently disclosed composition. Castability and rollability of the presently disclosed hot rolled composition are superior to a comparable hot rolled composition of similar tensile strength, containing boron, for example.

By excellent durability and crashworthiness it is meant tensile strength greater than about 1000 megapascals, and a yield/tensile ratio greater than about 65%.

The present multiphase steel may be manufactured by a method having the following steps:

i. Optionally, assembling a continuous metal slab caster having a casting mold, such as but not limited to a compact strip production facility.

ii. Introducing molten steel into the casting mold and continuously casting the molten steel into a slab, with a thickness that may be between about 25 and about 100 mm, the molten steel of a composition having: (a) a composition comprising the following elements by weight: carbon in a range from about 0.02% to about 0.2%, manganese in a range from about 1.0% to about 3.5%, phosphorous less than or equal to about 0.1%, silicon less than or equal to about 1.2%, aluminum in a range from about 0.01% to about 0.10%, nitrogen less than or equal to about 0.02%, copper less than or equal to about 0.5%, vanadium less than or equal to about 0.12%, at least one chosen from molybdenum, chromium, nickel, and a combination thereof, in a range between about 0.05% and about 3.5%, wherein, if present, molybdenum (Mo) is present with chromium (Cr) satisfying a relationship Mo+Cr greater than or equal to about 0.05% and less than or equal to about 2.0%, and, wherein, if present, nickel (Ni) is present with copper (Cu) satisfying a relationship Ni+Cu being less than or equal to about 0.8%, at least one metal chosen from titanium, niobium and a combination thereof, in a range between about 0.005% and about 0.5%, wherein, if present, titanium (Ti) is present with niobium (Nb) satisfying relationship Ti+Nb greater than or equal to about 0.005% and less than or equal to about 0.3%, the composition having no purposeful addition of boron, and the balance of the composition comprising iron and incidental ingredients;

iii. hot rolling the steel slab to form a hot rolled band, or a hot rolled sheet, and completing the hot rolling process at a finishing exit temperature, or hot rolling termination temperature, in a range between about (Ar3-30)° C. and about 1025° C. (about 1877° F.).

iv. after hot rolling, cooling the hot rolled steel at a mean cooling rate of at least about 3° C./s (about 37.4° F./s).

v. optionally, if a sheet form is prepared, coiling the cooled steel sheet at a temperature between about 425° C. (about 797° F.) and about 825° C. (about 1517° F.).

vi. further optionally, pickling the hot rolled steel to improve the surface quality thereof.

Typically the steel slab manufactured by the disclosed method has a thickness of approximately 50 mm to about 100 mm. Alternately, a steel slab thicker than 100 millimeters with the above chemical composition may be produced by continuous casting. For a thick slab, such as thicker than 100 millimeters, a reheating step, if needed, can be used prior to the hot rolling operation. In a reheating step, the steel slab is reheated to a temperature in the range between about 1025° C. (1877° F.) and about 1350° C. (2462° F.), followed by holding at this temperature for a period of not less than about 10 minutes.

An alternate process for producing the multiphase steel in accordance with the present disclosure includes the following steps:

i. Optionally, assembling a continuous metal slab caster having a casting mold, such as but not limited to a compact strip production facility;

ii. Introducing molten steel having a composition having elements within the ranges discussed above into the casting mold and continuously casting the molten steel into a slab;

iii. Optionally, for a thick slab only, such as a thickness greater than about 100 mm, reheating in a reheating furnace to a temperature in the range between about 1025° C. (1877° F.) and about 1350° C. (2462° F.), and alternately in a range between about 1050° C. (about 1922° F.) and about 1300° C. (about 2372° F.); and holding the thick steel slab in the specified temperature range for a time period of at least about 10 minutes, and alternately at least about minutes, in order to assure the uniformity of the initial microstructure of the thick slab before conducting the hot rolling process. For a thin slab, such as a thickness from about 25 mm to about 100 mm, the reheating process may be eliminated.

iv. Hot rolling the steel slab into a hot band, or a hot rolled sheet, and completing the hot rolling process at a finishing exit temperature, or hot rolling termination temperature, in a range between about (Ar3-30)° C. and about 1025° C. (about 1877° F.), and alternately in a range between about (Ar3-15)° C. and about 950° C. (about 1742° F.).

v. Cooling the hot rolled steel after completing hot rolling at a mean cooling rate at least about 3° C./s (about 37.4° F./s), and alternately at least about 5° C./s (about 41° F./s).

vi. Optionally, coiling the hot rolled steel by a conventional coiler when the hot band has cooled to a temperature not higher than about 825° C. (about 1517° F.). Coiling may be effected at any temperature below about 825° C. (about 1517° F.) down to the ambient temperature. Alternately, the coiling step may be performed at a temperature between about 500° C. (about 932° F.) and about 750° C. (about 1382° F.).

In one embodiment, the hot-rolled steel sheet presently disclosed has excellent coatability and/or galvanizability, and may be directly subjected to hot dip coating (such as hot dip galvanizing and, optionally, both galvanizing and galvannealing) in a continuous hot dip galvanizing line or subjected to an electrical galvanizing coating. For the presently disclosed hot-rolled steel, cold rolling can be eliminated, for example, before coating.

In the course of developing the presently disclosed multiphase steel, several types of low carbon molten steels were made using an Electric Arc Furnace and were then formed into thin steel slabs with thickness ranging from about 50 millimeters to 90 millimeters at the Nucor-Berkeley Compact Strip Production Plant, located in Huger, S.C.

The concentrations of the major chemical elements of several steels (A, B, and C) are presented in TABLE 1 below. These steels were manufactured according to the present methods, and the chemical elements of these steels, including those elements not shown in TABLE 1, were limited to the ranges specified by the present disclosure.

TABLE 1

Chemical compositions of exemplary samples of the presently disclosed multiphase steel sheet.

| | C | Mn | P | Si | Al | Ti + Nb | Cr + Mo | V | Cu + Ni | N |
|---|---|---|---|---|---|---|---|---|---|---|
| A | 0.080 | 2.21 | 0.013 | 0.54 | 0.034 | 0.043 | 1.1 | 0.0125 | 0.25 | 0.007 |
| B | 0.073 | 2.25 | 0.015 | 0.56 | 0.043 | 0.024 | 1.1 | 0.013 | 0.25 | 0.008 |
| C | 0.072 | 2.29 | 0.016 | 0.61 | 0.045 | 0.027 | 1.1 | 0.012 | 0.25 | 0.006 |

Each of the steel slabs was hot rolled to form respective hot bands using hot rolling termination temperatures or finishing exit temperatures ranging from (Ar3-15)° C. to 950° C. (1742° F.). Immediately after completing hot rolling, the hot rolled steel sheets were water cooled at a conventional run-out table using cooling rates faster than 10° C./s (18° F./s) down to the coiling temperatures ranging from 500° C. (932° F.) to 750° C. (1382° F.), and then were coiled at the corresponding temperatures. After hot rolling and coiling, some of the hot bands were pickled to improve surface quality.

Full thickness test pieces were taken from the hot rolled steel sheets along the longitudinal (L), and transverse (T) directions, and then the test pieces were machined into standard ASTM tensile specimens. The tensile testing was conducted in accordance with the standard ASTM E8 method on the specimens using an Instron 5567 Table Mounted Testing System with a capacity of 30 kN (6750 Ib), equipped with Merlin Software.

Mechanical properties of the final thickness specimens, including the yield strength, the tensile strength and the total elongation were measured during the tensile testing. More specifically, the yield strength was determined on the specimens at an offset strain of 0.2%.

The results of the material property measurements for the present multi-phase steel sheet specimens with a final thickness of 3.1-4.0 mm are presented below in TABLE 2.

TABLE 2

Mechanical properties of exemplary samples of the presently disclosed multiphase steel sheets.

| Steel | Thickness (mm) | Test Direction | Yield Strength (MPa) | Tensile Strength (MPa) | Elongation (%) | Yield/ Tensile Ratio (%) |
|---|---|---|---|---|---|---|
| A | 3.1 | L | 805 | 1052 | 13 | 77 |
| | 3.1 | T | 811 | 1065 | 11 | 76 |
| | 3.1 | L | 758 | 1025 | 12 | 74 |
| | 3.1 | T | 778 | 1038 | 12 | 75 |
| | 3.5 | L | 767 | 1050 | 12 | 73 |
| | 3.5 | T | 788 | 1058 | 11 | 75 |
| | 3.5 | L | 776 | 1051 | 12 | 74 |
| | 3.5 | T | 796 | 1064 | 11 | 76 |
| | 4.0 | L | 775 | 1035 | 11 | 75 |
| | 4.0 | T | 801 | 1050 | 12 | 76 |
| | 4.0 | L | 814 | 1043 | 12 | 78 |
| | 4.0 | T | 845 | 1069 | 11 | 79 |
| B | 3.1 | L | 722 | 1008 | 13 | 72 |
| | 3.1 | T | 748 | 1024 | 12 | 73 |
| | 3.1 | L | 819 | 1042 | 11 | 79 |
| | 3.1 | T | 937 | 1129 | 11 | 83 |
| | 3.5 | L | 753 | 1018 | 12 | 72 |
| | 3.5 | T | 783 | 1034 | 11 | 75 |

TABLE 2-continued

Mechanical properties of exemplary samples of the presently disclosed multiphase steel sheets.

| Steel | Thickness (mm) | Test Direction | Yield Strength (MPa) | Tensile Strength (MPa) | Elongation (%) | Yield/ Tensile Ratio (%) |
|---|---|---|---|---|---|---|
| | 3.5 | L | 764 | 1013 | 12 | 73 |
| | 3.5 | T | 780 | 1031 | 11 | 74 |
| C | 4.0 | L | 771 | 1018 | 13 | 73 |
| | 4.0 | T | 807 | 1036 | 11 | 77 |
| | 4.0 | L | 769 | 1022 | 14 | 73 |
| | 4.0 | T | 798 | 1038 | 12 | 76 |

T = transverse direction;
L = longitudinal direction

The material property data shown in TABLE 2 illustrate that the present hot rolled complex metallographic structured or multi-phase structured steel exhibit high tensile strength as well as high elongation, indicating that the presently disclosed steel has a good combination of strength and formability.

The yield strength is one parameter characterizing the dent resistance, durability and crashworthiness of steel. Higher yield strength improves dent resistance, durability and crashworthiness of the steel sheet. Accordingly, the complex metallographic structured or multi-phase structured steel manufactured according to the presently disclosed method possess better dent resistance, better durability, better intrusion resistance and better crashworthiness, compared to the commercial dual phase steel with a similar tensile strength. For this reason, the present multi-phase steel may enable certain sheet metal parts to be thinner than they would be using prior art steel, reducing part weight and improving structural functionality.

The complex metallographic structured or multi-phase structured steel manufactured in accordance with the present method were successfully formed into the desired parts without any difficulty, and various forming problems during casting, rolling, and/or subsequent drawing and/or stamping processes were not observed.

The presently disclosed hot rolled, high strength steel possesses a complex metallographic structure or multi-phase structure a multi-phase microstructure having in combination bainite between 15% and 45% by volume, martensite+austenite (M+A) constituent between 5% and 25% by volume, tempered and non-tempered martensite at less than 15% by volume, the remainder volume essentially ferrite.

in some embodiments, the hot rolled steel sheet of the present disclosure may comprise fine complex precipitates selected from the group of TiC, NbC, TiN, NbN, (Ti·Nb)C, (Ti·Nb)N, and (Ti·Nb)(C·N) particles.

Alternately, the martensite+austenite (M+A) constituent of the microstructure may be between 10% and 30% by volume. The bainite phase of the microstructure may be between 25% and about 40% by volume of the microstructure.

The steel sheet may subsequently be formed or press formed to manufacture the desired end shapes for any final applications.

FIGS. 3A, 3B and 3C exhibit scanning electron microscope (SEM) micrographs of Sample A of the present hot rolled multi-phase structure steels at 5000×, 8000×, and 10,000× magnification, respectively, while FIGS. 4A, 4B, and 4C exhibit scanning electron microscope (SEM) micrographs of Sample B of the present hot rolled multi-phase structure steels at 2500×, 5000×, and 7500× magnification, respectively. As evidenced by these SEM micrographs, hard martensite islands 105 are uniformly distributed in the matrix. The micrograph also shows the presence of a ferrite phase 106, a bainite phase 107, and martensite 105 and a martensite+austenite constituent 108 in the steel.

The complex metallographic structure or multi-phase structure including martensite, ferrite, bainite, and optionally fine complex precipitates, provide the above described desired properties. Further, steel sheet produced according to the present disclosure may be manufactured using existing, commercial manufacturing facilities. The composition of the multiphase steel of the present disclosure includes elements as described below.

Figure 5:
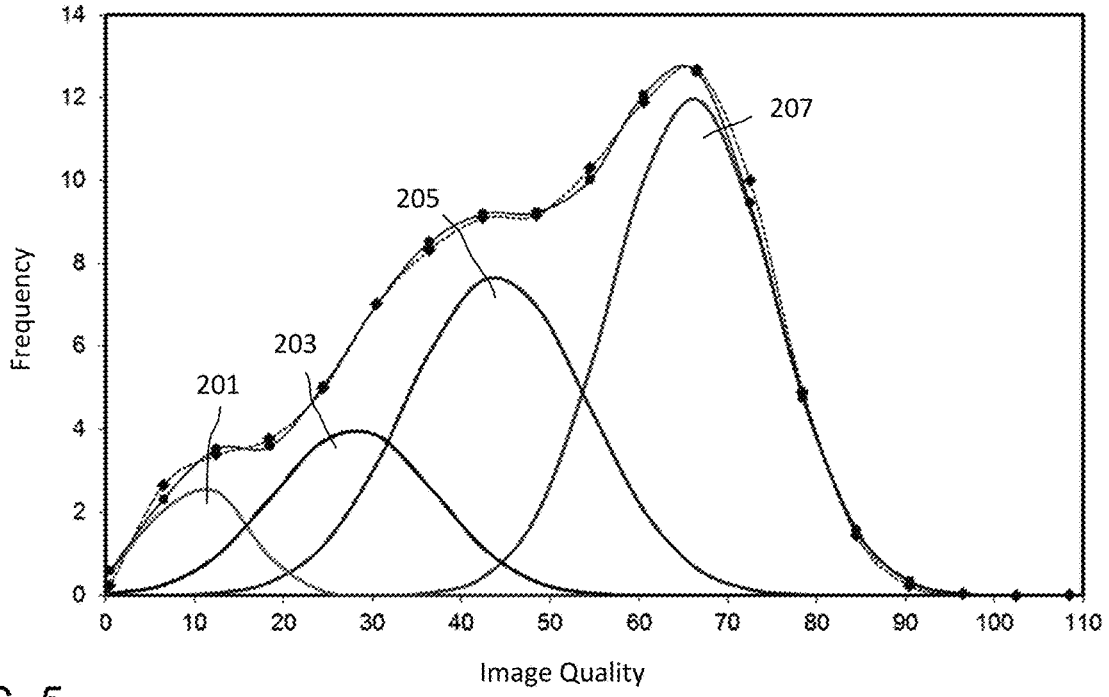
FIG. 5 is a microstructure phase distribution representation of an embodiment of the present disclosure.
Figure 6:
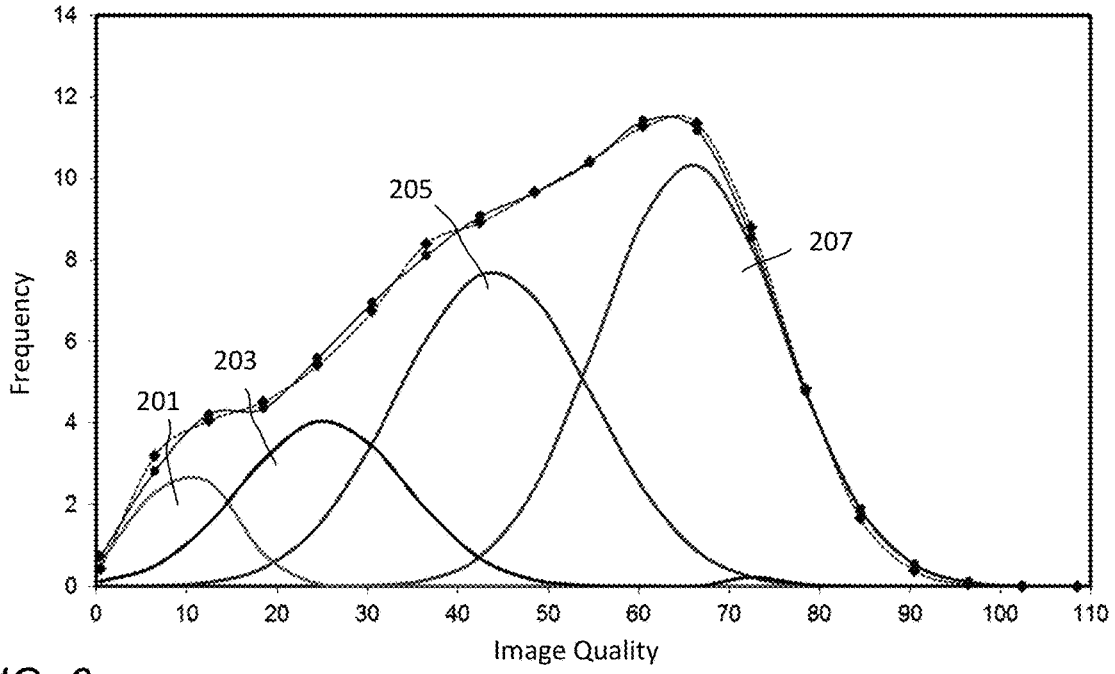
FIG. 6 is a microstructure phase distribution representation of an embodiment of the present disclosure.
Figure 7:
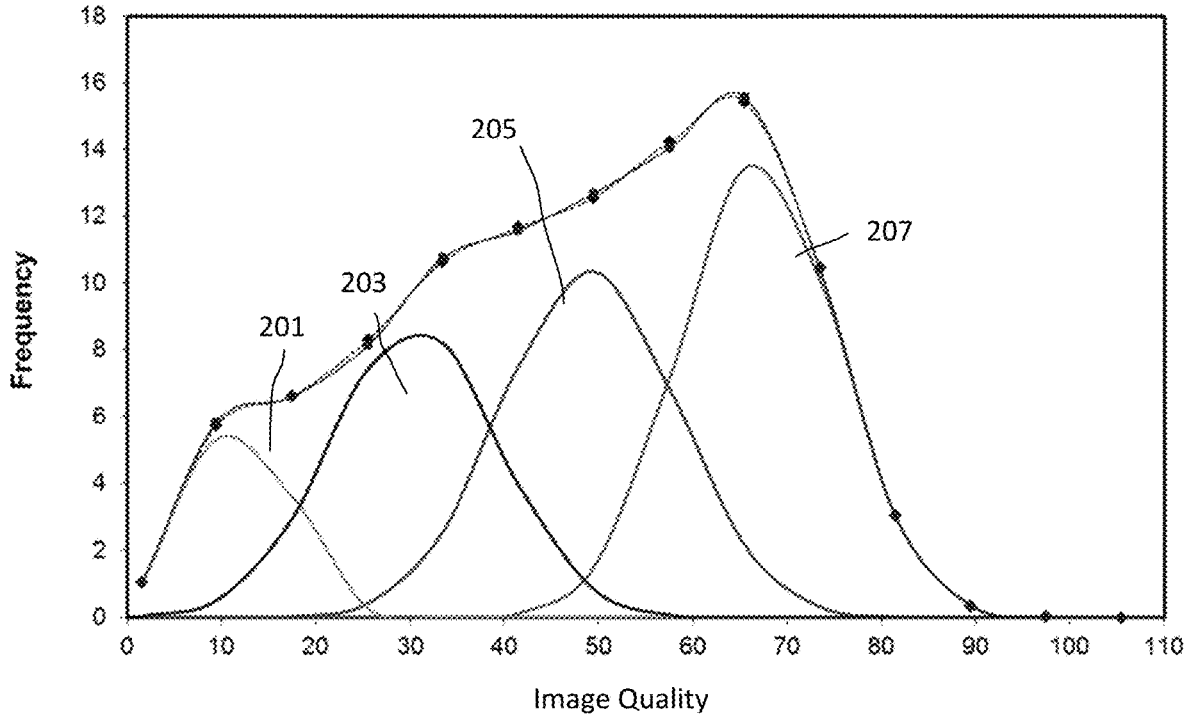
FIG. 7 is a microstructure phase distribution representation of an embodiment of the present disclosure.

The main phase of the microstructure of the presently disclosed steel sheet is ferrite. Ferrite can be present as a mixed microstructure of polygonal ferrite (PF) and quasi-polygonal ferrite. The total amount of ferrite is in a range of more than 20%, and preferably in a range of FIGS. 5, 6 and 7 depict phase distribution plots of presently disclosed samples of the hot rolled steel sheet of Sample A, Sample B and Sample C (described in Table 1), respectively. Phase distribution plots were determined using an orientation imaging microscope (OIM), where metallographic phases in the sample are quantified by differentiating the corresponding lattice distortion. The image quality parameters (IQ) describes the quality of an electron back scattering diffraction pattern. Different microconstituents or different phases differ mainly in their lattice distortion due to dislocations and solute interstitials. Higher lattice distortion corresponds to lower IQ, e.g., bainite and martensite, whereas lower lattice distortion corresponds to higher IQ, e.g., ferrite.

The deconvoluted curve-fitting plots of FIGS. 5, 6 and 7, respectively, show a tempered and non-tempered martensite phase 201 of less than 15% by volume (6.1, 6.3 and 10.1% respectively), a martensite+austenite constituent 203 of between 5 and 35% by volume (15.3, 15.5 and 24.0% respectively), a bainite phase 205 of between 20 and 40% by volume (32.7, 34.5 and 30.2% respectively), and a remainder ferrite phase 207 (45.9, 43.7 and 35.7% by volume, respectively).

Although the present invention has been shown and described in detail with regard to only a few exemplary embodiments of the invention, it should be understood by those skilled in the art that it is not intended to limit the invention to specific embodiments disclosed. Various modifications, omissions, and additions may be made to the disclosed embodiments without materially departing from the novel teachings and advantages of the invention, particularly in light of the foregoing teachings. Accordingly, it is intended to cover all such modifications, omissions, additions, and equivalents as may be included within the spirit and scope of the invention as defined by the following claims.

The invention claimed is:

1. A hot rolled, complex metallographic structured steel sheet comprising:

(a) a composition comprising the following elements by weight:

carbon in a range from 0.02% to 0.2%, manganese in a range from 1.0% to 3.5%, phosphorous less than or equal to 0.1%, silicon less than or equal to 1.2%, aluminum in a range from 0.01% to less than 0.10%, nitrogen less than or equal to 0.02%, copper less than or equal to 0.5%, vanadium less than or equal to 0.12%, the composition having no purposeful addition of boron, and the balance of the composition comprising iron and incidental ingredients; and a multi-phase microstructure only after hot rolling having in combination: bainite between 15% and 45% by volume, martensite+austenite (M+A) constituent between 5% and 35% by volume, tempered and non-tempered martensite at less than 15% by volume, a remainder volume essentially ferrite; the remainder volume comprising a mixture of polygonal ferrite (PF) and quasi-polygonal ferrite is present in a range of 30-60% by volume of the microstructure.

2. The hot rolled, complex metallographic structured steel sheet of claim 1, wherein carbon is in a range from 0.05% to 0.1% by weight.

3. The hot rolled, complex metallographic structured steel sheet of claim 1, further comprising:

at least one chemical element chosen from molybdenum, chromium, nickel, or a combination thereof, in a range between 0.05% by weight and 3.5% by weight; or molybdenum (Mo) present with chromium (Cr) satisfying a relationship Mo+Cr greater than or equal to 0.05% by weight and less than or equal to 2.0% by weight; or nickel (Ni) present with copper (Cu) satisfying a relationship Ni+Cu being less than or equal to 0.8% by weight.

4. The hot rolled, complex metallographic structured steel sheet of claim 1, further comprising at least one chemical element chosen from titanium, niobium and a combination thereof, in a range between 0.005% by weight and 0.8% by weight.

5. The hot rolled, complex metallographic structured steel sheet of claim 4, further comprising precipitates selected from the group consisting of TiC, NbC, TiN, NbN, (Ti·Nb)C, (Ti·Nb)N, or (Ti·Nb)(C·N).

6. The hot rolled, complex metallographic structured steel sheet of claim 1, comprising physical properties comprising tensile strength greater than 1000 megapascals.

7. The hot rolled, complex metallographic structured steel sheet of claim 1, comprising at least one of the following properties: elongation greater than 10% in accordance with ASTM E8; and yield strength/tensile strength ratio greater than 65%.

8. The hot rolled, complex metallographic structured steel sheet of claim 1, comprising at least one of the following properties: elongation of 10-16% in accordance with ASTM E8; and yield strength/tensile strength ratio of 70-85%.

9. The hot rolled, complex metallographic structured steel sheet of claim 1, wherein tensile strength is greater than 1000 megapascals, elongation is greater than 10% in accordance with ASTM E8, and yield/tensile ratio it is greater than 65%.

10. The hot rolled, complex metallographic structured steel sheet of claim 1, wherein tensile strength is greater than 1000 megapascals, elongation is 10-16% in accordance with ASTM E8, and yield/tensile ratio it is 70-85%.

11. The hot rolled, complex metallographic structured steel sheet of claim 1, wherein the martensite+austenite (M+A) constituent of the microstructure is between 10% and % by volume, and the bainite phase of the microstructure is between 25% and 40% by volume of the microstructure.

12. The hot rolled, complex metallographic structured steel sheet of claim 1, wherein the martensite+austenite (M+A) constituent of the microstructure is between 10% and % by volume, the bainite phase of the microstructure is between 25% and 40% by volume of the microstructure, and tempered and non-tempered martensite present at less than 15% by volume, the remainder volume of essentially ferrite present in the microstructure.

13. A hot rolled, complex metallographic structured steel sheet having a composition comprising the following elements by weight:

carbon in a range from 0.01% to 0.2%,
manganese in a range from 1.0% to 3.5%,
phosphorous less than or equal to 0.1%,
silicon less than or equal to 1.2%,
aluminum in a range from 0.01% to less than 0.10%,
nitrogen less than or equal to 0.02%,
copper less than or equal to 0.5%,
vanadium less than or equal to 0.12%,
the composition having no purposeful addition of boron,
and the balance of the composition comprising iron and incidental ingredients;

wherein only after hot rolling the hot rolled sheet has a uniform multiphase microstructure of:

bainite between 15% and 45% by volume;
martensite+austenite (M+A) constituent between 10% and 30% by volume;
tempered and non-tempered martensite present at less than 15% by volume; and
a remainder volume of a mixture of polygonal ferrite (PF) and quasi-polygonal ferrite,
the remainder volume present in a range of 30-60% by volume.

14. A hot rolled, complex metallographic structured steel sheet having a composition comprising the following elements by weight:

carbon in a range from 0.05% to 0.1%,
manganese in a range from 1.0% to 3.5%,
phosphorous less than or equal to 0.1%,
silicon less than or equal to 1.2%,
aluminum in a range from 0.01% to less than 0.10%,
nitrogen less than or equal to 0.02%,
copper less than or equal to 0.5%,
vanadium less than or equal to 0.12%,
the composition having no purposeful addition of boron,
and the balance of the composition comprising iron and incidental ingredients;

wherein only after hot rolling the hot rolled sheet has a uniform multiphase microstructure consisting of:

bainite present between 25% and 40% by volume of the microstructure;
martensite+austenite (M+A) constituent present between 10% and 30% by volume;
tempered and non-tempered martensite present at less than 15% by volume; and
a remainder volume of a mixture of polygonal ferrite (PF) and quasi-polygonal ferrite is present in a range of 30-60% by volume of the microstructure.

* * * * *